US010612338B2

(12) United States Patent
Rogers et al.

(10) Patent No.: US 10,612,338 B2
(45) Date of Patent: Apr. 7, 2020

(54) ADAPTING A TOP DRIVE CEMENT HEAD TO A CASING RUNNING TOOL

(71) Applicant: Halliburton Energy Services, Inc., Houston, TX (US)

(72) Inventors: Henry Eugene Rogers, Oklahoma City, OK (US); Phillip David Standifer, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 249 days.

(21) Appl. No.: 15/516,432

(22) PCT Filed: Nov. 14, 2014

(86) PCT No.: PCT/US2014/065779
§ 371 (c)(1),
(2) Date: Apr. 3, 2017

(87) PCT Pub. No.: WO2016/076890
PCT Pub. Date: May 19, 2016

(65) Prior Publication Data

US 2018/0334875 A1 Nov. 22, 2018

(51) Int. Cl.

| | |
|---|---|
| ***E21B 33/13*** | (2006.01) |
| ***E21B 33/05*** | (2006.01) |
| ***E21B 33/14*** | (2006.01) |
| ***E21B 43/10*** | (2006.01) |
| ***E21B 23/01*** | (2006.01) |

(52) U.S. Cl.
CPC ..... *E21B 33/05* (2013.01); *E21B 23/01* (2013.01); *E21B 33/14* (2013.01); *E21B 43/10* (2013.01)

(58) Field of Classification Search
CPC combination set(s) only.
See application file for complete search history.

(56) References Cited

U.S. PATENT DOCUMENTS 4,809,776 A * 3/1989 Bradley ..... E21B 33/05 166/153
4,946,201 A * 8/1990 Tai ..... E21B 17/042 285/334

(Continued)

FOREIGN PATENT DOCUMENTS

WO 2007/001887 A2 1/2007
WO 2007/127737 A1 11/2007

OTHER PUBLICATIONS

International Search Report and Written Opinion issued in related PCT Application No. PCT/US2014/065779 dated Jul. 22, 2015, 16 pages.

(Continued)

*Primary Examiner* — David J Bagnell
*Assistant Examiner* — Ronald R Runyan
(74) *Attorney, Agent, or Firm* — John W. Wustenberg; Baker Botts L.L.P.

(57) ABSTRACT

Systems and methods comprising a cement head fluidly connected to a casing string located within a wellbore; a receptacle having a receiving end and a cement head end, wherein the cement head end is connected to an upper end of the cement head; and a casing running tool comprising at least one slip, wherein the at least one slip engages the receiving end of the receptacle.

19 Claims, 3 Drawing Sheets

(56) References Cited

U.S. PATENT DOCUMENTS

| | | | | |
|---|---|---|---|---|
| 5,950,724 | A * | 9/1999 | Giebeler | E21B 33/05 166/155 |
| 6,142,545 | A * | 11/2000 | Penman | E21B 7/046 294/86.12 |
| 6,688,398 | B2 | 2/2004 | Pietras | |
| 7,021,374 | B2 | 4/2006 | Pietras | |
| 7,281,582 | B2 * | 10/2007 | Robichaux | E21B 21/02 166/177.4 |
| 7,325,610 | B2 * | 2/2008 | Giroux | E21B 7/20 166/177.4 |
| 7,510,006 | B2 * | 3/2009 | Juhasz | E21B 19/07 166/291 |
| 8,356,674 | B2 | 1/2013 | Murray et al. | |
| 2011/0048737 | A1 * | 3/2011 | Schneider | E21B 19/10 166/380 |
| 2011/0139435 | A1 | 6/2011 | Latiolais, Jr. et al. | |
| 2011/0280104 | A1 | 11/2011 | McClung, III | |
| 2012/0048533 | A1 | 3/2012 | Barker | |
| 2012/0273232 | A1 | 11/2012 | O'Blenes | |
| 2014/0151044 | A1 | 6/2014 | Robichaux et al. | |

OTHER PUBLICATIONS

International Preliminary Report on Patentability issued in related Application No. PCT/US2014/065779, dated May 26, 2017 (12 pages).

* cited by examiner

ADAPTING A TOP DRIVE CEMENT HEAD TO A CASING RUNNING TOOL

CROSS-REFERENCE TO RELATED APPLICATION

The present application is a U.S. National Stage Application of International Application No. PCT/US2014/065779 filed Nov. 14, 2014, which is incorporated herein by reference in its entirety for all purposes.

BACKGROUND

The present invention relates generally to operations performed and equipment utilized in conjunction with wellbore operations and, in particular, to rigging tools used in wellbore cementing operations.

During a typical drilling operation, the wellbore is lined with casing to maintain the drilled wellbore and allow the passage of drilling fluids, tools, production fluids and other materials into and out of the wellbore. The casing is often assembled by lowering a casing segment into the wellbore, gripping the casing segment and holding it in place using pipe slips or an elevator, connecting a second casing segment to the gripped casing segment, connecting the two casing segments, and lowering the combined segments into the well to repeat the process. This process is also referred to as running the casing. A casing running tool is often implemented to aid this process of assembling and running the casing.

After a casing running operation is completed, a cementing operation is typically commenced to complete the drilling operation. To transition from casing running to cementing, currently, operations that use a casing running tool (CRT) or drive tool to run casing must first remove the CRT or drive tool prior to rigging up the cement stand. This is time consuming, generally taking between 1.5 and 3 hours, and requires additional tools. After the CRT or drive tool is rigged down, only then can the cement head be installed and circulation operations initiated.

FIGURES

Some specific exemplary embodiments of the disclosure may be understood by referring, in part, to the following description and the accompanying drawings.

Figure 1:
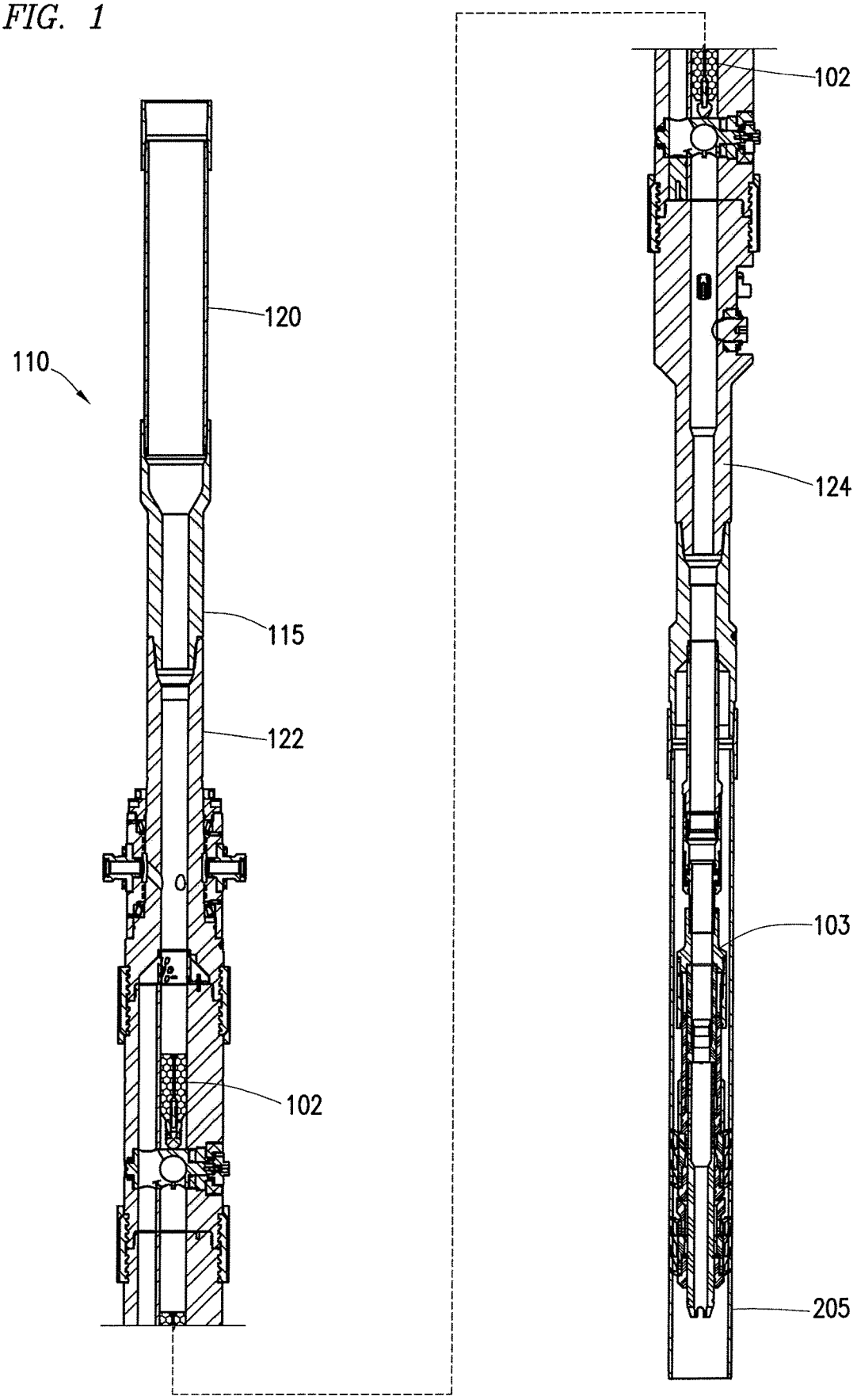
FIG. 1 illustrates a cross-sectional view of a cementing head system comprising a cementing head and a casing running tool receptacle, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present invention relates generally to operations performed and equipment utilized in conjunction with wellbore operations and, in particular, to rigging tools used in wellbore cementing operations.

Illustrative embodiments of the present disclosure are described in detail herein. In the interest of clarity, not all features of an actual implementation may be described in this specification. It will of course be appreciated that in the development of any such, actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or direct connection. Thus, if a first device couples to a second device, that connection may be through a direct connection, or through an indirect mechanical or electrical connection via other devices and connections. The term "uphole" as used herein means along the drillstring or the hole from the distal end towards the surface, and "downhole" as used herein means along the drillstring or the hole from the surface towards the distal end.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may further be applicable to borehole construction for river crossing tunneling and other such tunneling boreholes for near surface construction purposes or borehole u-tube pipelines used for the transportation of fluids such as hydrocarbons. Devices and methods in accordance with embodiments described herein may be used in one or more of measurement-while-drilling and logging-while-drilling operations.

The present disclosure describes a cementing head tool that may be used in a cementing operation, such as a COMMANDER FB, for example. The cementing head may comprise a CRT receptacle that may allow the CRT or drive tool to be attached directly to the cement head, thereby eliminating the entire rig down time.

Once a wellbore (or a wellbore section) has been drilled, casing is run into the wellbore during a running phase and then the casing is cemented into the wellbore during a cementing phase. During the running phase, a casing running tool may be used to run the casing into the wellbore. For example, in certain embodiments, the casing running tool may be a CASING SPECIALTIES CRT. For example, the casing running tool may facilitate adding a section of casing to an uphole end of a casing string within the wellbore to extend the casing string further into the wellbore. Once the casing string reaches the desired total depth (TD), the running phase may be ended.

Following the running phase, the cementing phase may be initiated to cement the casing string into the wellbore.

Switching from the running phase to the cementing phase may comprise keeping the casing running tool rigged up, connecting a cement head to the casing string, and stabbing the casing running tool into the cement head.

Referring to FIG. 1, an example cementing head 110 is shown, in accordance with the present disclosure. The cementing head 110 may comprise a casing running tool (CRT) receptacle 120. The cementing head 110 may comprise any cementing head known to one of ordinary skill in the art. In certain embodiments, the cementing head may be a top-drive cementing head (TDH). For example, the cementing head 110 may be a COMMANDER 1000 Top-Drive Cementing Head from Halliburton, Houston, Tex., United States. In certain embodiments, the CRT receptacle 120 may be connected to a cementing head upper end 122 via a CRT adapter 115. The CRT adapter 115 may fluidly connect the CRT receptacle 120 and the cementing head upper end 122.

As an example, the cementing head 110 is depicted herein as comprising a subsurface release plug (an SSR plug) set 102 and water bushing tool 103; however the cementing head 110 may be configured to comprise any combination of tools used in a cementing operation, as would be recognized by one of ordinary skill in the art with the benefit of the present disclosure.

After completion of a casing running operation, the cementing head 110 may be connected to the casing string 205 and/or stabbed into the casing string 205 at a cementing head connecting end 124. For example, in certain embodiments, the water bushing tool 103 may be stabbed into the casing string 205 and connect the cement head 110 to the casing string 205, as shown in FIG. 1. In certain embodiments, an elevator may be used to lift and connect the cementing head 110 to the casing string 205.

In certain embodiments, the casing running tool 220 may be in a rigged up configuration, as during the casing running operation, while connecting the cementing head 110 to the casing string 205. The casing running tool 220 may remain in the rigged up configuration while the cementing head 110 is picked up with an elevator and attached to and/or stabbed into the casing string 205.

Figure 2:
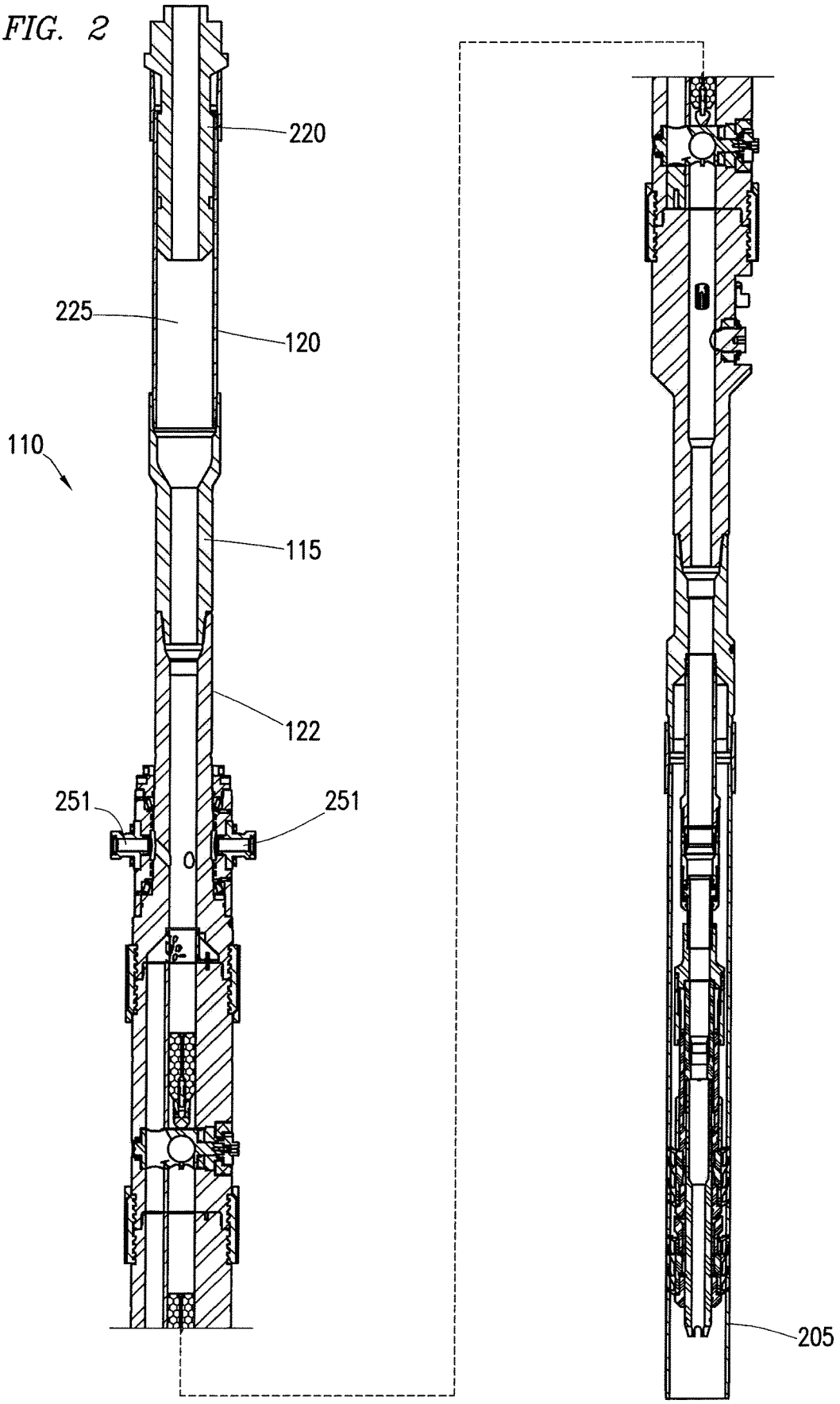
FIG. 2 illustrates a cross-sectional view of a cementing head system comprising a cementing head and a casing running tool receptacle with a casing running tool stabbed into the casing running tool receptacle, according to aspects of the present disclosure.

Once the cementing head 110 is connected to the casing string 205, a casing running tool 220 may be stabbed into and engage the CRT receptacle 120, as shown by example in FIG. 2. The receptacle 120 may comprise an inner cavity 225 with an inner diameter capable of receiving a first end of the casing running tool 220. In certain embodiments, the inner cavity 225 may have an inner diameter of substantially the same size as the inner diameter of the casing string 205. As such, the dimensions of the inner cavity 225 may vary depending on the parameters and conditions of the operation. For example, in certain embodiments, the inner cavity 225 may have a diameter that depends on the particular type and/or the dimensions of the casing string 205 used in the casing running operation. In certain embodiments, the inner cavity 225 may be tubular. For example, in certain embodiments, the inner cavity 225 may be formed from smooth tubing.

Figure 3:
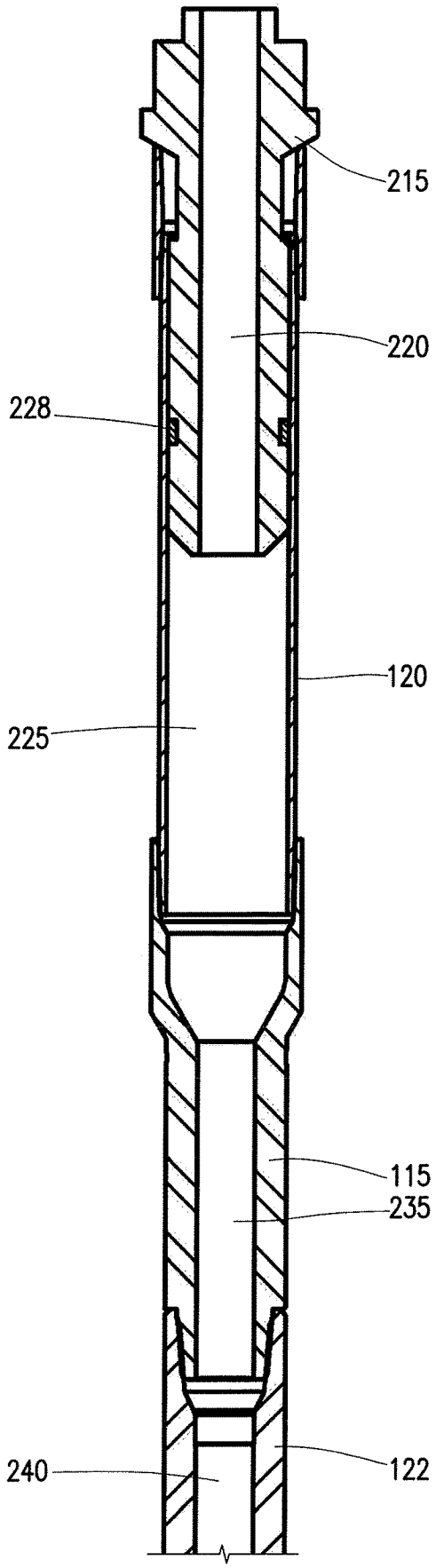
FIG. 3 is a zoomed in view of a casing running tool stabbed into a casing running tool receptacle, according to aspects of the present disclosure.

Referring to FIG. 3, a close-up view of the casing running tool 220 stabbed into the CRT receptacle 120 is shown. In certain embodiments, the casing running tool 220 may comprise at least one slip 215 that may engage the CRT receptacle 120. The at least one slip 215 may transfer mechanical force from the casing running tool 220 to the CRT receptacle 120. In certain embodiments, the at least one slip 215 may be structured and arranged to engage the CRT receptacle 120 and impede the casing running tool 220 from being stabbed further into the CRT receptacle 120. In certain embodiments, the at least one slip 215 may comprise a mechanical slip, a hydraulic slip, or any other mechanism to create frictional force and/or transfer mechanical torque from the casing running tool 220 to the CRT receptacle 120. In certain embodiments, the CRT adapter 115 may transfer mechanical torque from the CRT receptacle 120 to the cementing head upper end 122. In certain embodiments, the at least one slip 215 may create a seal 228 with the CRT receptacle 120 when the casing running tool 220 is stabbed into the CRT receptacle 120.

As discussed above, in certain embodiments, the CRT receptacle 120 may be connected to a CRT adapter 115. The CRT adapter may connect the cementing head upper end 122 with the CRT receptacle 120. In certain embodiments, the CRT adapter may comprise an inner passage 235. In certain embodiments, the inner passage 235 may have a variable inner diameter structured and arranged to transition from the CRT receptacle inner cavity 225 to a cementing head inner passage 240. For example, in certain embodiments, the CRT adapter inner passage 235 may have a diameter substantially equal to the CRT receptacle inner cavity diameter at a first end and have a diameter substantially equal to the cementing head inner passage 240 at a second end. In certain embodiments, the CRT adapter inner passage 235 may taper at a variable or constant rate. For example, the CRT adapter inner passage 235 may taper at a constant rate for a first portion of the inner passage 235 and have a constant diameter for a second portion of the inner passage 235, as shown in FIG. 3.

Referring back to FIG. 2, after the casing running tool 220 is stabbed into the receptacle 120, cement may be directed into at least one cement inlet port 251 and through the cementing head 110 toward the casing 205, as known to one of ordinary skill in the art with the benefit of the present disclosure.

In certain embodiments, the casing running tool 220 may apply a downward mechanical force on the CRT receptacle 120. This downward mechanical force may be transferred to the cementing head 110 by the CRT adapter 115. The cementing head 110 may transfer the downward mechanical force to the casing string 205. In addition, the casing running tool 220 may apply torque to the CRT receptacle 120. The CRT receptacle 120 may transfer torque received from the casing running tool 220 to the CRT adapter 115, which may then transfer torque to the cementing head 110. The cementing head 110 may transfer received torque to the casing string 205 causing the casing string to rotate. As such, rotation of the casing running tool 220 may allow rotation of the casing string 205 within the wellbore during cementing operations.

In certain embodiments, a method may comprise providing a cementing head comprising a receptacle connected to an upper end of the cementing head connecting the cementing head to a casing string located within a wellbore; engaging the receptacle with a casing running tool; and directing cement into the cement head through at least one cement inlet port disposed on the cement head.

In certain embodiments, a method of cementing a casing string in a wellbore, may comprise running the casing string into the wellbore with a casing running tool; providing a cementing head comprising a receptacle connected to an upper end of the cementing head; connecting the cementing head to the casing string located within the wellbore; inserting a stab section of the casing running tool into an inner cavity located within the receptacle; engaging the receptacle with at least one slip disposed on the casing running tool;

directing cement into the cement head through at least one cement inlet port disposed on the cement head; and rotating the casing string by applying a rotational force to the receptacle with the casing running tool.

The present disclosure may allow the casing running tool to engage with and/or couple to the cementing head using the receptor as an adaptor for the casing running tool. The present disclosure may allow rotation of the casing during the cementing operation. In addition, the present disclosure may significantly reduce the transition time required from the casing running operation to the cementing operation. As a result, the present disclosure may improve the operator's control over slurry placement in the wellbore and zonal isolation of the wellbore. The present disclosure may be used in conjunction with an offshore or on land drilling operation.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A system, comprising:

a cement head fluidly connected to a casing string located within a wellbore;

a receptacle having a receiving end and a cement head end, wherein the cement head end is connected via a casing running tool adapter to an upper end of the cement head, wherein the casing running tool adapter comprises an inner passage with a variable inner diameter that transitions from an inner cavity of the receptacle to an inner passage of the cementing head to fluidly connect the receptacle and the upper end of the cement head; and a casing running tool comprising at least one slip, wherein the at least one slip engages the receiving end of the receptacle and impedes the casing running tool from being stabbed further into the receptacle, wherein a downward mechanical force applied by the casing running tool is transferred to the cementing head by the casing running tool adapter, and wherein the casing running tool applies a torque to the receptacle which transfers the torque to the cementing head.

2. The system of claim 1, wherein the at least one slip forms a seal with the receiving end of the receptacle.

3. The system of claim 1, wherein the casing running tool is stabbed into the receptacle.

4. The system of claim 1, wherein the inner cavity has a substantially equal diameter to a diameter of the casing string.

5. The system of claim 1, wherein rotation of the casing running tool applies a rotational force to the receptacle causing the cement head to rotate.

6. The system of claim 1, wherein the cement head comprises a top-drive cement head.

7. The system of claim 1, wherein the at least one slip is a mechanical slip.

8. The system of claim 1, wherein the cement head comprises at least one subsurface release plug.

9. The system of claim 1, wherein the cement head comprises a water bushing tool.

10. A method, comprising:

providing a cementing head comprising a receptacle connected via a casing running tool adapter to an upper end of the cementing head, wherein the casing running tool adapter comprises an inner passage with a variable inner diameter that transitions from an inner cavity of the receptacle to an inner passage of the cementing head to fluidly connect the receptacle and the upper end of the cement head;

connecting the cementing head to a casing string located within a wellbore;

engaging the receptacle with a casing running tool with at least one slip disposed on the casing running tool;

impeding the casing running tool from being stabbed further into the receptacle by the at least one slip; and directing cement into the cement head through at least one cement inlet port disposed on the cement head, wherein a downward mechanical force applied by the casing running tool is transferred to the cement head by the casing running tool adapter, and wherein the casing running tool applies a torque to the receptacle which transfers the torque to the cement head.

11. The method of claim 10, wherein engaging the receptacle with the casing running tool comprises forming a seal between the casing running tool and the receptacle.

12. The method of claim 10, wherein the at least one slip comprises a mechanical slip or a hydraulic slip.

13. The method of claim 10, wherein the cementing head comprises a top-drive cementing head.

14. The method of claim 10, further comprising rotating the casing string by applying a rotational force to the receptacle with the casing running tool.

15. The method of claim 10, further comprises applying a downward force to the casing string by applying a compression force to the receptacle.

16. A method of cementing a casing string in a wellbore, comprising:

running the casing string into the wellbore with a casing running tool;

providing a cementing head comprising a receptacle connected via a casing running tool adapter to an upper end of the cementing head, wherein the casing running tool adapter comprises an inner passage with a variable inner diameter that transitions from an inner cavity of the receptacle to an inner passage of the cementing head to fluidly connect the receptacle and the upper end of the cement head;

connecting the cementing head to the casing string located within the wellbore;

inserting a stab section of the casing running tool into the inner cavity located within the receptacle;

engaging the receptacle with at least one slip disposed on the casing running tool, wherein a downward mechanical force applied by the casing running tool is transferred to the cementing head by the casing running tool adapter, and wherein the casing running tool applies a torque to the receptacle which transfers the torque to the cementing head;

impeding the casing running tool from being stabbed further into the receptacle by the at least one slip;

directing cement into the cement head through at least one cement inlet port disposed on the cement head; and rotating the casing string by applying a rotational force to the receptacle with the casing running tool.

17. The method of claim 16, wherein engaging the receptacle with at least one slip forms a seal between the at least one slip and the receptacle.

18. The method of claim 16, wherein directing cement into the cement head and rotating the casing string occurs at the same time.

19. The method of claim 16, wherein the casing running tool is not rigged down before connecting the cementing head to the casing string.

* * * * *